US007036301B2

(12) United States Patent
Wassenhoven

(10) Patent No.: US 7,036,301 B2
(45) Date of Patent: May 2, 2006

(54) CHANNEL PLATE ADAPTER FOR AN OPEN-END ROTOR SPINNING ARRANGEMENT

(75) Inventor: Heinz-Georg Wassenhoven, Mönchengladbach (DE)

(73) Assignee: Saurer GmbH & Co., KG, Monchengladbach (DE)

( * ) Notice: Subject to any disclaimer, the term of this patent is extended or adjusted under 35 U.S.C. 154(b) by 97 days.

(21) Appl. No.: 10/757,327

(22) Filed: Jan. 14, 2004

(65) Prior Publication Data

US 2004/0154280 A1 Aug. 12, 2004

(30) Foreign Application Priority Data

Feb. 8, 2003 (DE) ..... 103 05 279

(51) Int. Cl.
*D01H 4/08* (2006.01)

(52) U.S. Cl. ..... 57/404; 57/417
(58) Field of Classification Search ..... 57/404–417
See application file for complete search history.

(56) References Cited

U.S. PATENT DOCUMENTS

| | | | | |
|---|---|---|---|---|
| 4,610,134 | A | 9/1986 | Busch et al. | 57/417 |
| 4,854,119 | A | 8/1989 | Stahlecker et al. | 57/417 |
| 5,522,635 | A * | 6/1996 | Downey | 296/100.16 |
| 5,937,630 | A | 8/1999 | Wassenhoven | 57/407 |
| 6,224,066 | B1 * | 5/2001 | Oetiker | 277/634 |

FOREIGN PATENT DOCUMENTS

| | | |
|---|---|---|
| DE | 25 38 258 A1 | 3/1977 |
| DE | 37 29 425 A1 | 1/1988 |
| DE | 39 40 046 A1 | 6/1991 |
| DE | 43 34 485 A1 | 4/1995 |
| DE | 195 02 917 C2 | 8/1996 |
| DE | 196 03 730 A1 | 8/1997 |
| DE | 197 29 192 A1 | 1/1999 |
| DE | 295 22 172 U1 | 6/2000 |
| DE | 100 57 272 A1 | 5/2002 |
| EP | 1 072 701 A1 | 1/2001 |

OTHER PUBLICATIONS

European Search Report.
German Search Report.

* cited by examiner

*Primary Examiner*—John J. Calvert
*Assistant Examiner*—Shaun R. Hurley
(74) *Attorney, Agent, or Firm*—Kennedy Covington Lobdell & Hickman, LLP

(57) ABSTRACT

A channel plate adapter 24 is provided for an open-end spinning arrangement 1 having a spinning rotor 3 which turns at a high number of revolutions inside a rotor housing 2 chargable with an underpressure. The channel plate adapter 24 is made of a plastic material, defines the orifice area of a fiber guide conduit and a center through-bore 26 for a yarn withdrawal nozzle 27, and is adapted to be exchangeably arranged in a receiver 22 of a fiber channel plate 10 for closing the rotor housing during a spinning operation. The channel plate adapter (24) has a unitary one-piece clip-on closure (37) at inlet area of the through-bore (26) for centering and fixing the yarn withdrawal nozzle (27) in place.

9 Claims, 3 Drawing Sheets

CHANNEL PLATE ADAPTER FOR AN OPEN-END ROTOR SPINNING ARRANGEMENT

CROSS-REFERENCES TO RELATED APPLICATIONS

This application claims the benefit of German patent application 10305279.8 filed Feb. 8, 2003, herein incorporated by reference.

BACKGROUND OF THE INVENTION

The present invention relates to a channel plate adapter for an open-end rotor spinning arrangement.

Open-end rotor spinning arrangements are commonly equipped with an exchangeable channel plate adapter in the area of their fiber channel plate, as is known and extensively described, for example, in German Patent Publication DE 43 34 485 A1.

During the spinning operation of such open-end rotor spinning arrangements, a spinning rotor turns at a high rate of revolutions in a rotor housing, to which a suction force is applied to create an underpressure in the housing.

In the course of this operation, the rotor housing is closed by means of a pivotably arranged cover, into which a sliver opening device of the spinning arrangement is additionally integrated. More specifically, a lip seal is arranged in an annular groove of a so-called fiber channel plate and rests against the front of the rotor housing to effect the closure of the housing.

In such case, the fiber channel plate is either an integral component of the cover, or is releasably fixed on the cover. Additionally, a channel plate adapter is exchangeably arranged in a centered receiver of the fiber channel plate and forms a portion of a fiber guide channel, as well as carrying a yarn withdrawal nozzle in a centered through-bore.

In order to assure an optimum yarn feed, as well as a good yarn withdrawal, the channel plate adapters are each matched to a defined spinning rotor shape, or size. For this reason the channel plate adapter is also often exchanged in circumstances in which the spinning rotor may be changed, for example, in the case of a batch change.

Various embodiments are known for accomplishing the fastening of such exchangeable channel plate adapters. For example, a channel plate adapter is described in German Patent Publication DE 43 34 485 A1, wherein the channel plate adapter can be fixed in place in an airtight manner in the receiver of the fiber channel plate by means of screws extending through the back of the receiver. However, this manner of fastening requires the use of a tool.

In contrast thereto, channel plate adapters as described in German Patent Publication DE 197 29 192 A1 can be exchanged without tools. These known channel plate adapters are equipped with a central extension with lateral fixation elements, as viewed in the installation direction.

In particular, the channel plate adapter in this arrangement is uniformly fixed in place in the receiver of the fiber channel plate by means of the action of these fixation elements arranged approximately in the area of the center axis of the channel plate adapter by means of appropriate arresting means. Thus, false air is prevented from entering the rotor housing.

Channel adapter plates of this type have a central through-bore, in which is arranged a yarn withdrawal nozzle which, in general practice, is also exchangeable. Different embodiments also exist for accomplishing the releasable fastening of such yarn withdrawal nozzles.

German Patent Publication DE 39 40 046 A1, for example, describes a yarn withdrawal nozzle having an orifice funnel made of a ceramic material, which is fixed in place in a steel orifice support, preferably by adhesive. The orifice support itself has an outer thread, which can be screwed into a corresponding inner thread in the area of the central through-bore of the channel plate adapter.

Another form of releasable yarn-withdrawal nozzle as described in German Patent Publication DE 195 02 917 C2, has a ceramic orifice funnel with a ferromagnetic contact surface on its back. This ferromagnetic contact surface acts together with permanent magnets fixedly embedded into the channel plate adapter.

It has also been proposed in German Patent Publication DE 37 29 425 A1 to fix the yarn withdrawal nozzle exchangeably on a fiber channel plate with the aid of special additional clip-on closures. In this case, the clip-on closures are either fastened on the fiber channel plate to snap into corresponding shoulders at the yarn withdrawal nozzle, or the clip-on closures are a component of the yarn withdrawal nozzle which act together with corresponding installations at the fiber channel plate.

The above described installations for the interchangeable fixing in place of a yarn withdrawal nozzle each have various disadvantages. The arrangement known from German Patent Publication DE 37 29 425 A1, for example, is somewhat elaborate because of its various individual parts whereby the production costs of such channel plate adapters are relatively high.

Another open-end spinning arrangement is known from German Patent Publication DE 196 03 730 A1 wherein the channel plate adapter is made of plastic in a cost-effective manner and is exchangeably arranged in a receiver of the fiber channel plate. Here, a fiber guide channel produced from a wear-resistant material is molded into the plastic channel plate adapter.

SUMMARY OF THE INVENTION

In view of the above mentioned prior art, it is an object of the present invention to develop a cost-effective, exchangeable channel plate adapter which allows a simple and dependable fixation in place of an exchangeable yarn withdrawal nozzle.

In accordance with the present invention, this objective is addressed by means of a channel plate adapter designed for an open-end spinning arrangement basically having a spinning rotor which turns at a high number of revolutions inside a rotor housing chargable with an underpressure. The channel plate adapter is comprised of a plastic material and defines an orifice area of a fiber guide conduit and a central through-bore for a yarn withdrawal nozzle, and the channel plate adapter is designed to be exchangeably arranged in a receiver of a fiber channel plate of the open-end spinning arrangement for closing the rotor housing during a spinning operation. In accordance with the present invention, the channel plate adapter has a unitary one-piece clip-on closure at an inlet area of the through-bore for centering and fixing the yarn withdrawal nozzle thereat.

The channel plate adapter in accordance with the present invention has the particular advantage that it can be produced substantially more cost-efficiently than any of the channel adapter plates heretofore known. In particular, the one piece configuration of the clip-on closure of the present channel plate adapter assures not only a dependable fixation in place of the yarn withdrawal nozzle, but also makes sure that the yarn withdrawal nozzle can be easily exchanged any time it is necessary.

The preferred embodiment of such a clip-on closure furthermore enables an exact centering of the yarn withdrawal nozzle to be achieved, as well as a perfect fixation in place. Specifically, in the preferred embodiment, the centering members of the clip-on closure, which are shaped in the form of arcuate segments, rest with their interior diameter directly against the maximum exterior diameter of the yarn withdrawal nozzle and in this way center the yarn withdrawal nozzle exactly.

Since the clip elements of the clip-on closure simultaneously extend at least partially around the edge contour of the yarn withdrawal nozzle, the yarn withdrawal nozzle is moreover immediately securely held in place.

It is further preferred that the yarn withdrawal nozzle when fixed in place in its operating position simultaneously fixes in place a small wear protection tube, which is also exchangeably arranged in the through-bore of the channel plate adapter. In this case, one end of the small wear protection tube rests against a rear detent inside the through-bore, and the other end is fixed in place by the clipped-in yarn withdrawal nozzle.

Preferably, the wear protection tube is made of a highly wear-resistant material to prevent the yarn being created and withdrawn through the yarn withdrawal nozzle from working itself into the plastic body of the channel plate adapter. Suitable highly wear-resistant materials are, for example, ceramic materials, alloyed steel, etc.

The yarn withdrawal nozzle preferably is also made of such a highly wear-resistant material, which generally is preferred to be a commercial ceramic material.

The present invention will be described in greater detail hereinafter with respect to an exemplary embodiment represented in the accompanying drawings.

DESCRIPTION OF THE PREFERRED EMBODIMENT

Figure 1:
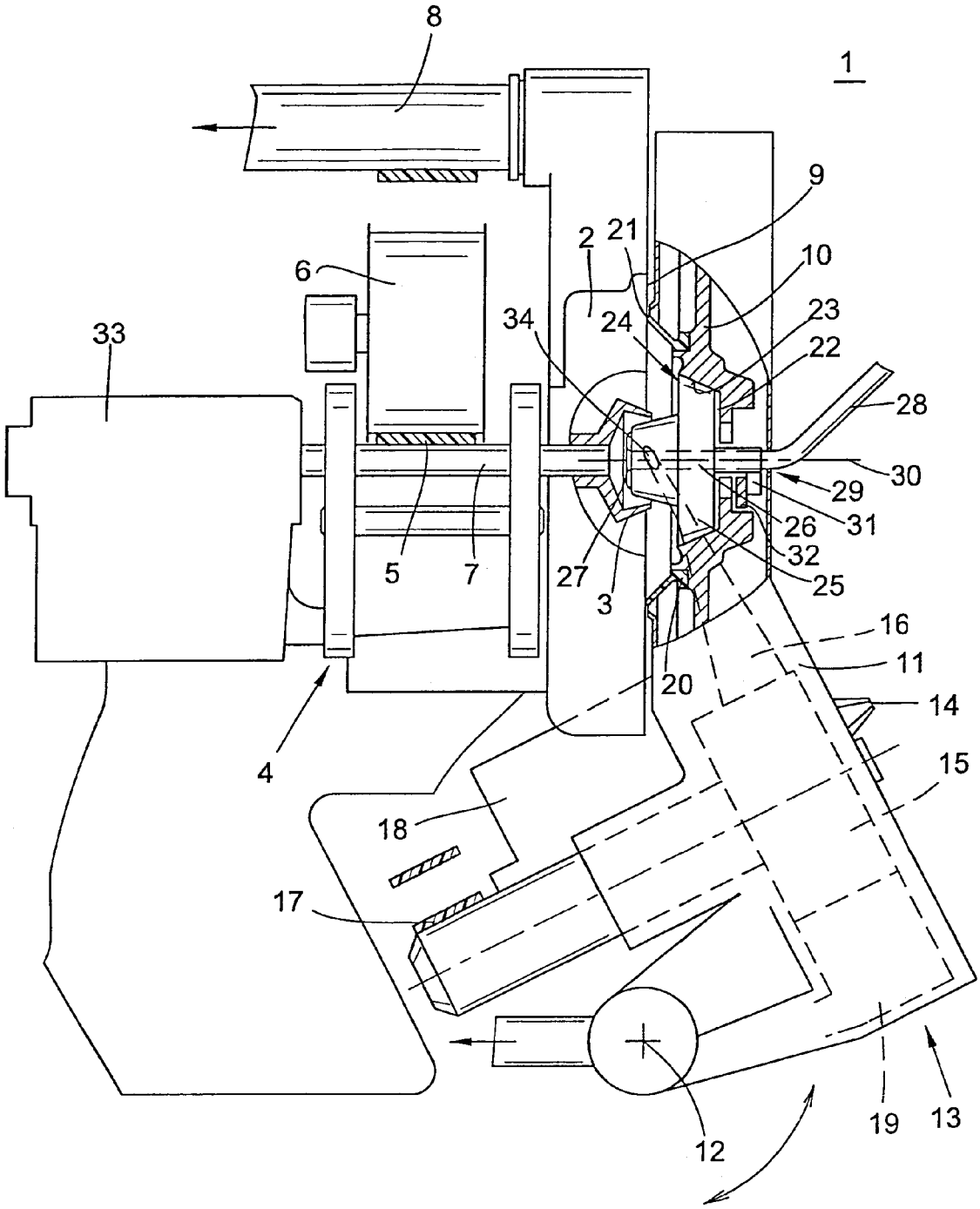
FIG. 1 is a side elevational view, partially broken away and sectioned, of an open-end rotor spinning arrangement having a spinning rotor revolving in a rotor housing closed by a cover having an integrated fiber channel plate with a receiver for positioning an exchangeable channel plate adapter in accordance with the present invention.

Referring now to the accompanying drawings and initially to FIG. 1, an open-end rotor spinning arrangement 1, shown in a lateral view, has a rotor housing charged with a suction underpressure, in which housing a spinning rotor 3 revolves at a high number of revolutions. In this embodiment, the spinning rotor 3 is supported by means of its rotor shaft 7 in a known manner on a supporting ring bearing 4, while the axial positioning of the spinning rotor 3 is provided via an axial bearing 33. In a known manner, the spinning rotor 3 is driven by a tangential belt 5, which extends over the length of the machine and is maintained in driving engagement against the rotor shaft 7 by means of a pressure roller 6.

The rotor housing 2 is connected via a suction line 8 to a source of suction or underpressure (not represented) for creating the necessary spinning underpressure within the housing 2.

On its front 9, the rotor housing 2 is closed by a so-called fiber channel plate 10, which is a part of a cover embodied as a pivotable housing member 11 pivotably seated on a pivot shaft 12. The fiber channel plate 10 may be either an integral part of the pivotable housing member 11, or the fiber channel plate 10 may be releasably fastened on the pivotable housing member 11.

As also indicated in FIG. 1, further components of the open-end rotor spinning arrangement 1, for example a sliver opening device 13, are installed in the pivotable housing member 11. Thus, a sliver to be fed into the open-end rotor spinning arrangement 1 is pulled into the opening device 13 by means of a sliver infeed cylinder 14, not represented in detail herein, and is separated into individual fibers by a sliver opening roller 15. Thereafter, the individual fibers are conveyed to the spinning rotor 3 through a fiber guide channel 16.

In this embodiment, the sliver opening roller 15 is preferably driven by means of a tangential belt 17, while the sliver infeed cylinder 14 is driven by means of either a driveshaft extending over the length of the machine (not shown) or an individual electric motor drive mechanism 18.

Additionally, a debris collecting chamber 19 for the sliver-borne debris that is liberated in the course of opening the sliver can be arranged in the pivotable housing member 11 underneath the sliver opening roller 15 and may be pneumatically charged to draw in such debris. In the depicted embodiment, the debris collecting chamber 19 is connected via an appropriate suction line to a central debris disposal unit of the open-end rotor spinning arrangement.

The fiber channel plate 10 embedded in the pivotable housing member 11 has a ring-shaped cutout 20 for positioning a lip sealing element 21, as well as a receiver 22, open in the direction of the rotor housing 2, for an exchangeable channel plate adapter 24. The lateral contact face 23 of the receiver 22 is preferably frusto-conical in shap. Such a design makes it possible to assure that the channel plate adapter 24 is exactly angularly aligned and is positioned airtight with its insert body 25 in the receiver 22 of the fiber channel plate 10. Thus, such an embodiment prevents leaks because of fitting errors which can possibly occur in the course of inserting the channel plate adapter 24.

Figure 2:
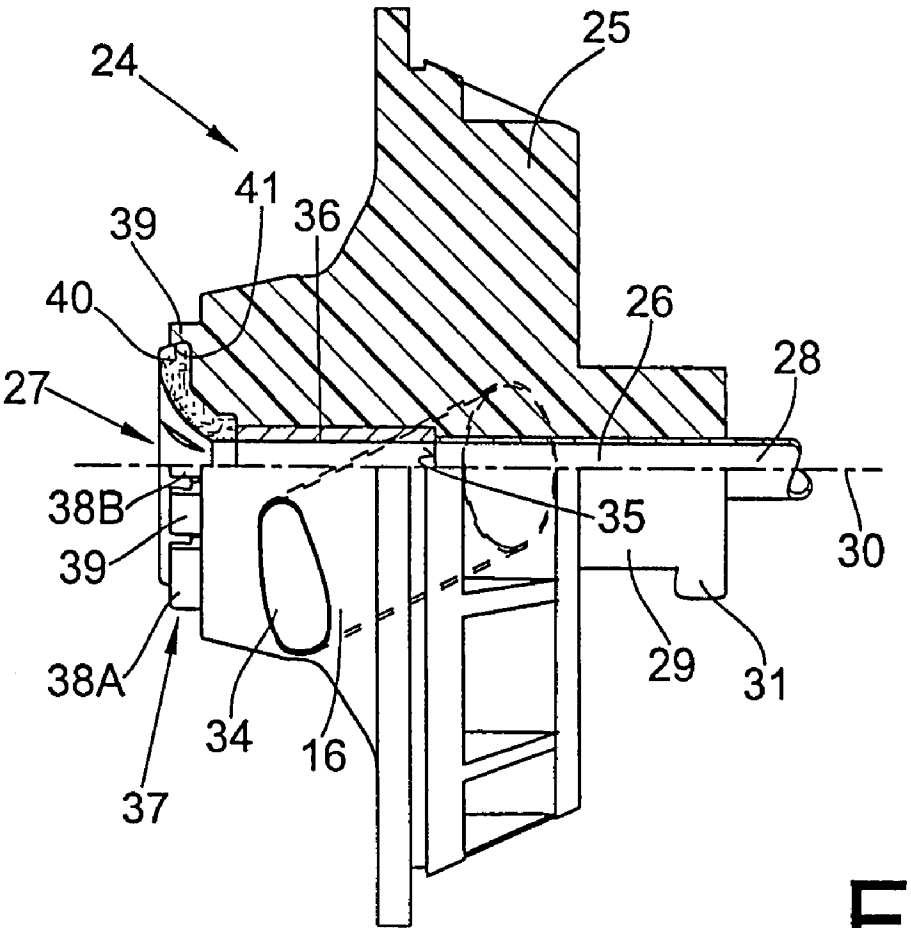
FIG. 2 is a partially sectioned side elevational view of the channel plate adapter in accordance with the present invention.
Figure 3:
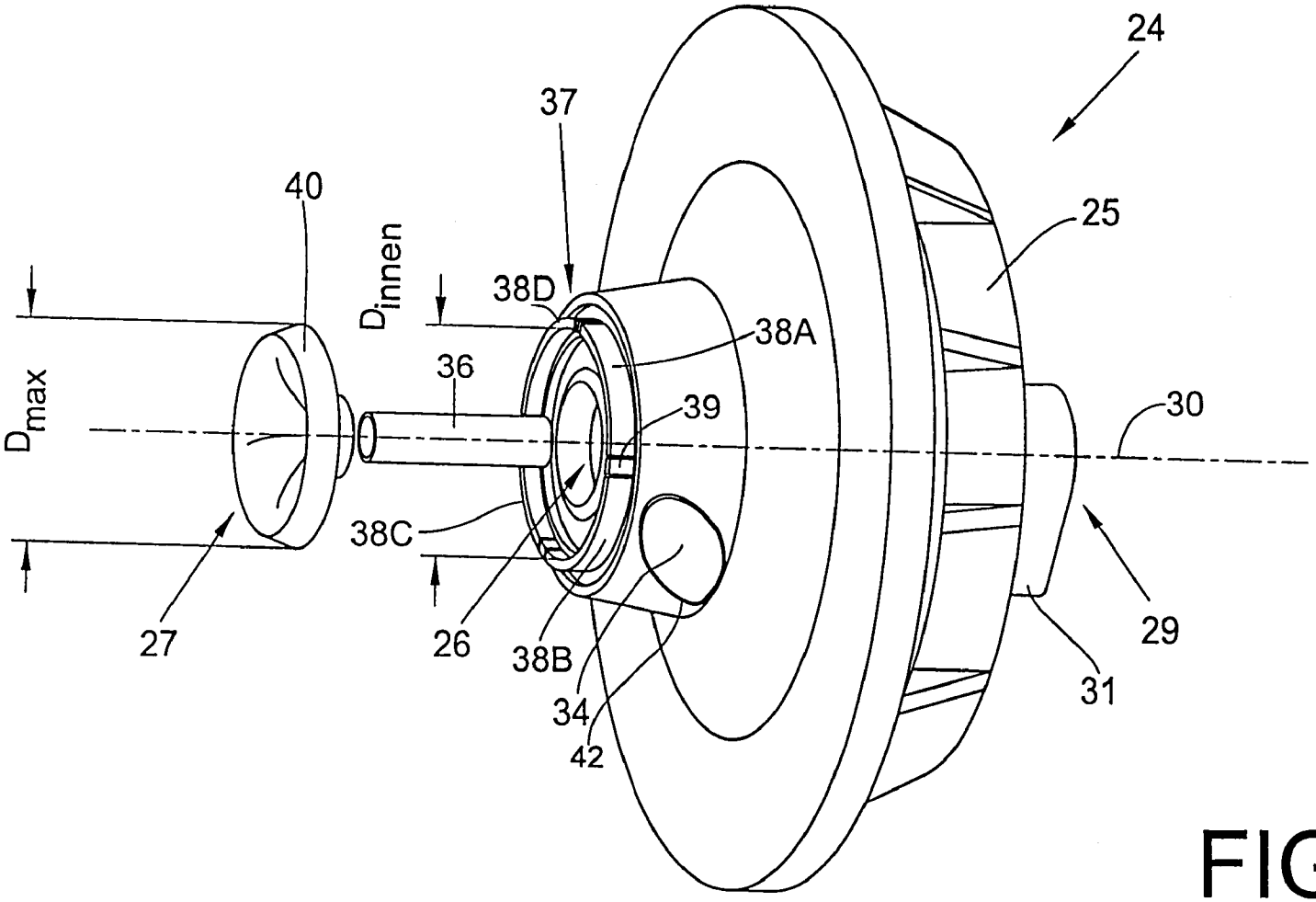
FIG. 3 is a top perspective view of the channel plate adapter in accordance with the present invention, depicting in exploded form a yarn withdrawal nozzle, which can be fixed in place in a central through-bore, and a downstream-connected small wear protection tube.

Preferably, the channel plate adapter 24 is made of a plastic material and, as can be seen in FIGS. 2 and 3 in particular, the channel plate adapter 24 defines an orifice area 34 of the fiber guide channel 16, as well as a central through-bore 26 for a yarn-withdrawal nozzle 27 located opposite the spinning rotor 3. In this embodiment, the fiber guide channel 16 is constituted by a wear-resistant insert 42 fixed inside the channel plate adapter 24 by the molding therof together in the course of manufacture of the channel plate adapter 24 from a plastic material.

In the operational state, a small wear protection tube 36 is arranged in the central through-bore 26 adjacent and in coaxial alignment with the yarn withdrawal nozzle 27, and is followed by a small coaxial yarn withdrawal tube 28. Preferably, the small yarn-withdrawal tube 28 extends through a bore in a hub portion 29 of the insert body 25 having at least one fixation shoulder 31 at the end of the hub portion 29. The fixation shoulder 31 essentially extends orthogonally in respect to the longitudinal axis 30 of the insert body 25, and an arresting means 32 extends behind the shoulder 31. This type of fastening of a channel plate adapter is known and extensively described by way of example in German Patent Publication DE 197 29 192 A1.

In the area of its central through-bore 26, the channel plate adapter 24 in accordance with the invention has a clip-on closure 37, which is formed as one piece on the plastic body of the channel plate adapter 24. This clip-on closure 37 serves to fix the yarn withdrawal nozzle 27 in place and has centering elements 38 and clip-on elements 39. In this embodiment, the centering elements 38 are designed in the arcuate form of segments of a circle 38A, 38C, etc., having a common interior diameter $D_{innen}$ selected such that it lies only slightly above the maximum diameter $D_{max}$ of the edge contour 40 of the yarn withdrawal nozzle 27.

The clip-on elements 39 are respectively arranged between the centering elements 38 and, on their interior side facing the yarn withdrawal nozzle 27, the clip-on elements 39 each have a conical contact face 41, which corresponds to a correspondingly embodied conical contact face on the exterior of the edge contour 40 of the draw-in nozzle 27. In this manner, the clip-on elements 39 partially extend over the outside of the edge contour 40 of the yarn withdrawal nozzle 27. In the operating state, not only is the yarn withdrawal nozzle 27 fixed in a secure and easily exchangeable manner, but the small wear protection tube 36 is likewise securely positioned in the central through-bore 26.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A channel plate adapter for an open-end spinning arrangement having a spinning rotor which turns at a high number of revolutions inside a rotor housing chargable with an underpressure, the channel plate adapter being comprised of a plastic material and defining an orifice area of a fiber guide conduit and a central through-bore for a yarn withdrawal nozzle, the channel plate adapter being adapted to be exchangeably arranged in a receiver of a fiber channel plate of the open-end spinning arrangement for closing the rotor housing during a spinning operation, wherein the channel plate adapter has a unitary one-piece clip-on closure at an inlet area of the through-bore for centering and fixing the yarn withdrawal nozzle thereat and wherein the clip-on closure comprises rigid centering elements mated to an edge contour of the yarn withdrawal nozzle, and elastic clip-on elements.

2. The channel plate adapter in accordance with claim 1, wherein the clip-on closure has at least two of the centering elements arranged at a spacing from each other and at least one of the clip-on elements arranged therebetween to at least partially extend over the edge contour of the yarn withdrawal nozzle.

3. The channel plate adapter in accordance with claim 2, wherein the centering elements have a shape in the form of an arcuate segment and are arranged relative to one another to define a mutual interior diameter for resting engagement of the yarn withdrawal nozzle with a maximum exterior diameter thereof against the mutual interior diameter of the centering elements.

4. The channel plate adapter in accordance with claim 2, wherein each of the clip-on elements has a conically extending interior contact face which corresponds to a conical exterior face of the edge contour of the yarn withdrawal nozzle.

5. The channel plate adapter in accordance with claim 2, wherein a wear protection tube is arranged in the through-bore of the channel plate adapter on a detent to be fixed in place by the yarn withdrawal nozzle when fixed in its operating position by the clip-on closure.

6. The channel plate adapter in accordance with claim 5, wherein the wear protection tube is made of a wear-resistant material.

7. The channel plate adapter in accordance with claim 6, wherein the wear protection tube is made of steel.

8. The channel plate adapter in accordance with claim 5, wherein the wear protection tube is made of a ceramic material.

9. The channel plate adapter in accordance with claim 5, wherein the yam withdrawal nozzle is made of a ceramic material.

* * * * *